US005167463A

United States Patent [19]

Corbishley

[11] Patent Number: 5,167,463

[45] Date of Patent: Dec. 1, 1992

[54] RING BINDER

[76] Inventor: Thomas S. Corbishley, 42 Oakleigh Drive, Croxley Green, Hertfordshire, United Kingdom, WD3 3EF

[21] Appl. No.: 651,232

[22] PCT Filed: Aug. 18, 1989

[86] PCT No.: PCT/GB89/00961

§ 371 Date: Feb. 7, 1991

§ 102(e) Date: Feb. 7, 1991

[87] PCT Pub. No.: WO90/02051

PCT Pub. Date: Mar. 8, 1990

[30] Foreign Application Priority Data

Aug. 23, 1988 [GB] United Kingdom ..... 8820000

[51] Int. Cl.[5] ..... B42F 3/00

[52] U.S. Cl. ..... 402/8; 402/13; 402/19; 402/73

[58] Field of Search ..... 402/8, 7, 13, 15, 19, 402/21, 75, 76, 80 P, 73, 74, 77; 281/29, 35; 283/64

[56] References Cited

U.S. PATENT DOCUMENTS

| | | | |
|---|---|---|---|
| 4,174,909 | 11/1979 | Jahn | 402/13 |
| 4,192,620 | 3/1980 | Jahn | 402/15 |
| 4,256,411 | 3/1981 | Podosek | 402/73 |
| 4,261,664 | 4/1981 | Crawford | 402/13 |

FOREIGN PATENT DOCUMENTS

| | | |
|---|---|---|
| G3708432.1 | 6/1987 | Fed. Rep. of Germany . |
| 2614841 | 5/1987 | France . |
| 1209770 | 10/1970 | United Kingdom . |
| 2213432A | 12/1987 | United Kingdom . |

*Primary Examiner*—Timothy V. Eley
*Assistant Examiner*—Willmon Fridie
*Attorney, Agent, or Firm*—Nixon & Vanderhye

[57] ABSTRACT

A ring binder (1) comprises a sheet of polypropylene material divided by score line (2, 3) into front and rear panels (4, 6) joined by a spine (5). The binder includes a pair of binder strips (7), each of which has a partly circular head (8). The strips (7) and heads (8) are cut from the sheet material so that the strips (7) extend from the spine (5) at a position adjacent the score line (3). The strips (7) are associated with apertures (11) formed in spine (5). The heads (8) can pass through apertures (11) without deformation.

9 Claims, 5 Drawing Sheets

RING BINDER

TECHNICAL FIELD

This invention relates to a ring binder.

BACKGROUND ART

In U.S. Pat. No. 4,192,620, there is described a ring binder comprising a sheet of material arranged to be bent so as to form a front panel and a rear panel joined by a spine and three binder strips. Each binder strip extends from the rear panel at a position adjacent the spine and is provided with a head at its free end. Each binder strip is associated with an aperture formed in the spine. When binding sheet articles, the head of each binder strip is passed through its associated aperture and secured in position. This binder suffers from the disadvantage that, as the front and rear panels are opened and closed, the position from which each binder strip extends from the rear panel and the associated aperture move relative to each other thereby creating stresses at the anchor point between the strip and the rear panel.

DISCLOSURE OF THE INVENTION

It is an object of this invention to provide a new or improved binder in which the above mentioned disadvantage is overcome or reduced.

According to one aspect of this invention, there is provided a binder comprising a sheet of material arranged to be bent so as to form a front panel and a rear panel, at least one binder strip, the or each binder strip extending from said sheet at a respective first position, an individual head provided at the free end of the or each strip, means for permitting the or each head to be passed from one surface of the sheet to another surface of the sheet at a respective second position, and means for securing the or each head in position after it has been passed from said one surface to said other surface, said respective first position and said respective second position associated with the or each strip lying in a common plane when the front or rear panels are closed together.

In the binder of this invention, the stresses which are described above in relation to the said U.S. Pat. No. 4,192,620 are avoided.

At least one strip may be arranged for binding a device, for example a pen, to a surface of the binder. For the or each strip which is so arranged, the strip and its associated head may be cut from said material and the respective first position may be located adjacent the edge of the sheet, whereby the permitting means is provided by said edge of the sheet and the securing means is provided by the aperture which is formed by cutting the strip and head from the material.

At least two of said strips may be arranged for binding sheet articles, for example paper, to the binder. Conveniently, said sheet of material is arranged to be bent so as to form a central spine between the front and rear panels and, for each strip which is arranged for binding sheet articles, the respective first and second positions are located on the spine, and the permitting means comprises an aperture formed in the spine at said second position. Desirably, for each strip which is so arranged, the head and the aperture are configured so that the head can pass through the aperture without deformation. For each strip which is so arranged, the strip and its associated head may be cut from said material, whereby the securing means is provided by the aperture which is formed by cutting the strip and head from the material.

In the binder described in the said U.S. Pat. No. 4,192,620, the head of each binder strip has to be deformed as it passes through its associated aperture. Consequently, this binder suffers from the further disadvantage that it has to be formed from a sheet of highly flexible material.

It is another object of this invention to provide a new or improved binder in which this further disadvantage is overcome or reduced.

According to another aspect of this invention, there is provided a binder comprising a sheet of material arranged to be bent so as to form a front panel and a rear panel, at least two strips extending from said sheet, an individual head provided at the free end of each strip, each binder strip and its associated head being cut from said material and thereby forming a first individual aperture associated with the strip, and an individual second aperture associated with each strip and formed in said sheet, in which each head has a partly circular shape and each strip, its associated head and its associated first and second apertures are arranged so that the head can pass through the second associated aperture without deformation and then through the first associated aperture to be secured in position against the surface of the material and form a binder ring.

With the binder of this invention, as the heads of the strips can pass through their associated second apertures without deformation, the binder can be formed from semi-rigid material.

BRIEF DESCRIPTION OF THE DRAWINGS

This invention will now be described in more detail, by way of example, with reference to the drawings in which.

MODES OF CARRYING OUT THE INVENTION

Figure 1:
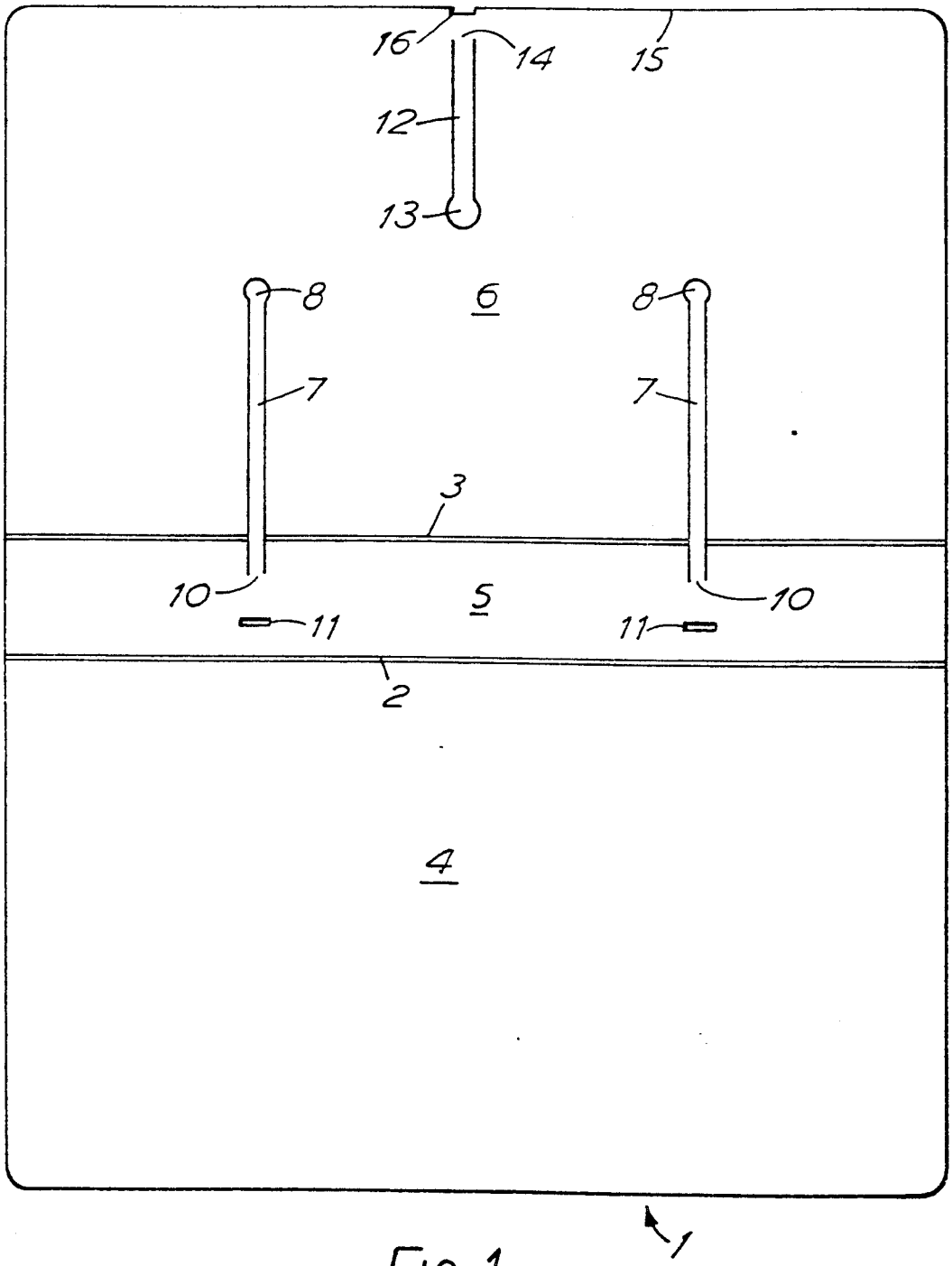
FIG. 1 is a view of a binder embodying this invention in an opened up state.
Figure 2:
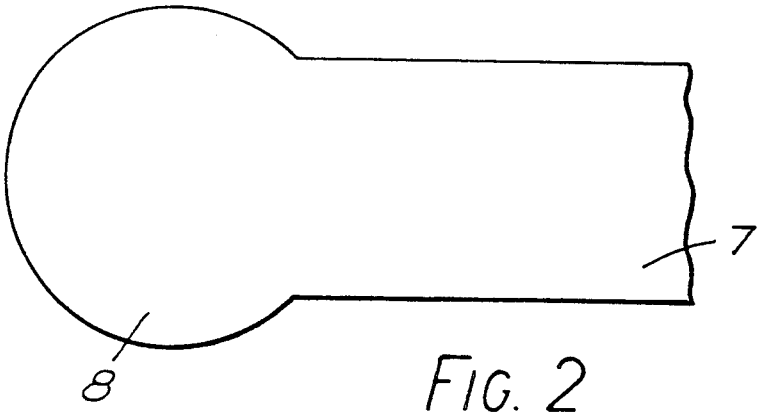
FIG. 2 is a scrap view of the end of a binder strip and its associated head.

Referring now to FIG. 1, there is shown a binder 1 formed from polypropylene material divided by score lines 2, 3 into a front panel 4, a spine 5, and a rear panel 6. The binder includes a pair of binder strips 7, each of which is provided with a head 8 at its free end. Each binder strip 7 and its associated head 8 is cut from the polypropylene material. In FIG. 1, each strip 7 and its head 8 are shown fitted into the apertures from which they are cut. In the remaining figures, each of these apertures is designated by reference numeral 9. When removed from these apertures, each of the strips 7 extends from the spine 5 at a position 10 located adjacent the score line 3. Each of the strips 7 is associated with a rectangular slit or aperture 11 located adjacent the score line 2. Each aperture 11 may be formed by punching a rectangular piece of material from the spine 5 or by forming a three sided slit in spine 5. As shown in FIG. 2, each head 8 has a partly circular shape, the diameter of the circle being slightly less than the longer dimension of the associated slit 11.

The binder also includes a strip 12 having a partly circular head 13, strip 12 and head 13 being cut from the rear panel 6 and the strip 12 extending from the rear panel at a position 14 located adjacent an edge 15. A notch 16 is formed in edge 16 adjacent position 14. As will be described, strip 12 may be used for binding a device, such as a pen, to rear panel 6. For reasons of simplicity, strip 12 is not shown in the remaining figures.

A binding operation will now be described with reference to FIGS. 3 to 8. For reasons of clarity, the material to be bound is not shown in these figures. Such material normally consists of sheet articles, such as paper, each of which has a size similar to the front and rear panels 4 and 6 and each of which is provided with a pair of circular holes at a spacing corresponding to the distance between the two strips 7.

Figure 3:
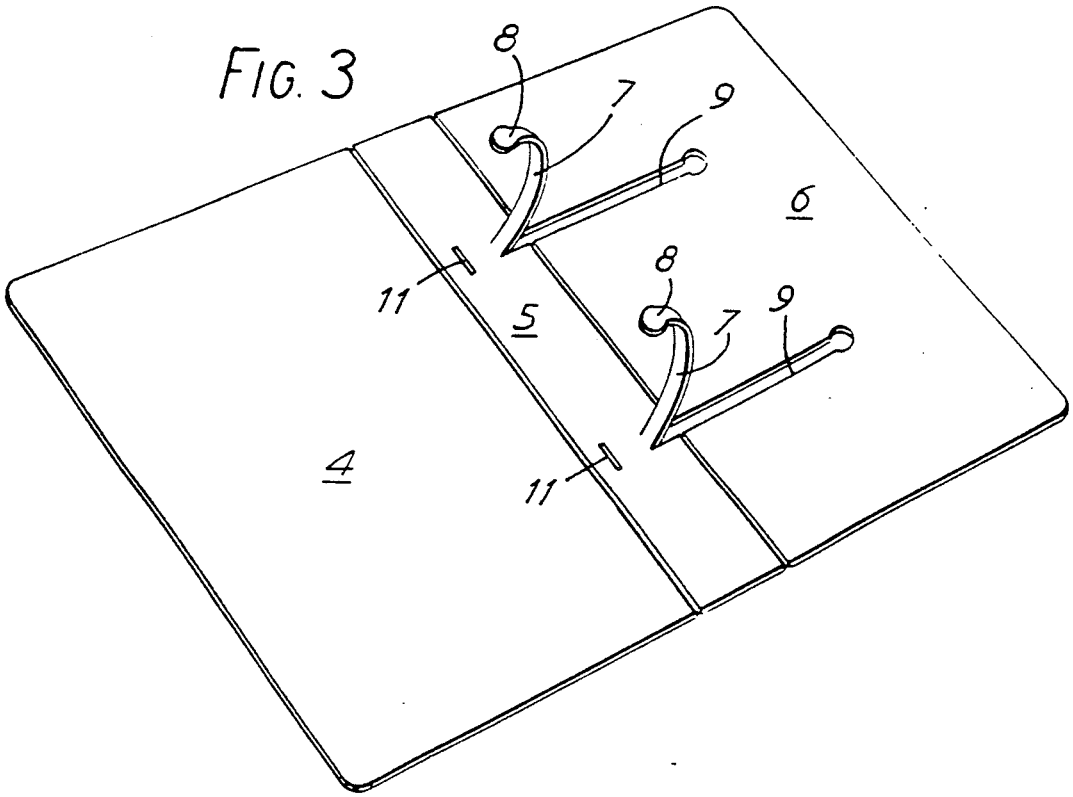
FIG. 3 is a perspective view of the binder of FIG. 1 just before the commencement of a binding operation.
Figure 4:
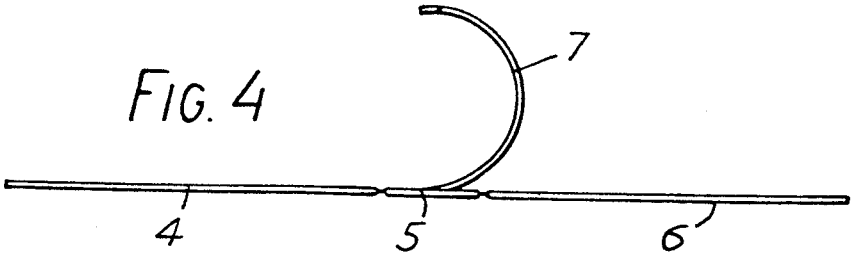
FIG. 4 is an end view of the binder in the state shown in FIG. 3.
Figure 5:
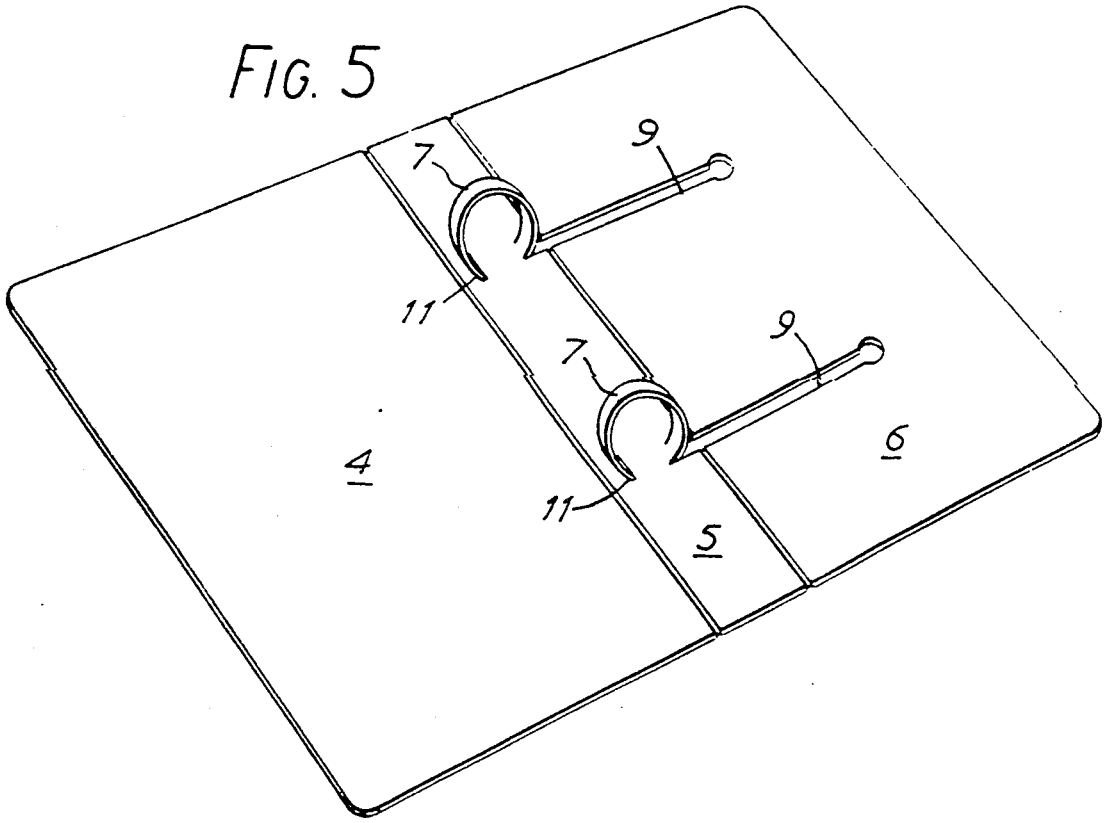
FIG. 5 is a perspective view of the binder of FIG. 1 after the first stage of a binding operation.
Figure 6:
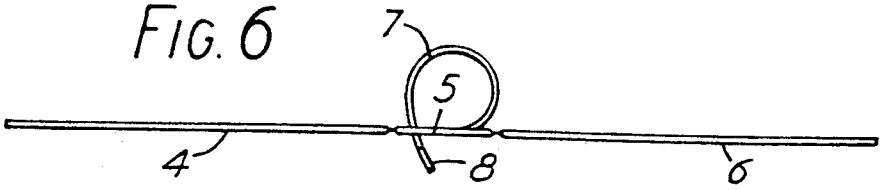
FIG. 6 is an end view of the binder in its state shown in FIG. 5.

As illustrated in FIGS. 3 and 4, before binding, the strips 7 are removed from their apertures 9. As shown in FIGS. 5 and 6, at the first stage of binding, the heads 8 and consequently the strips 7 are passed firstly through the holes of the material to be bound. Then, the heads 8 are passed from the inner surface of binder 1 through the apertures 11 to the outer surface. The shape of the heads 8 and apertures 11 permit this to be performed without deforming either the heads 8 or the apertures 11.

Figure 9:
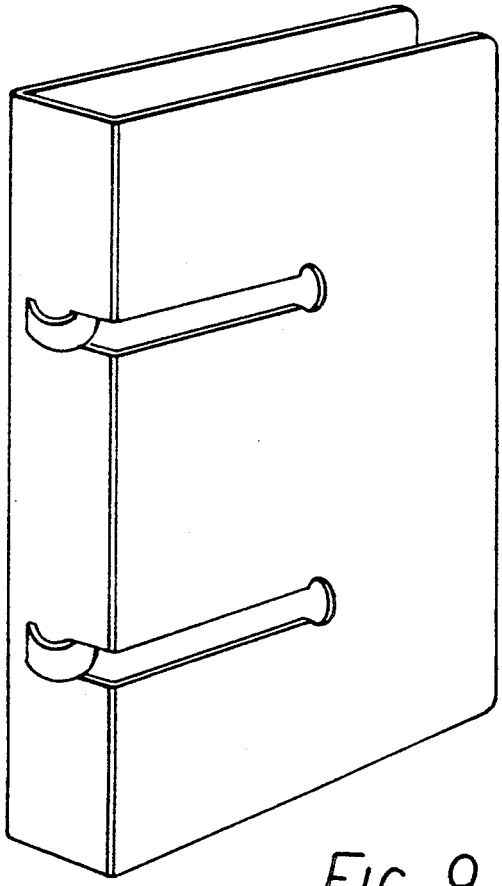
FIG. 9 is a perspective view of the outside of the binder of FIG. 1 after the completion of a binding operation.
Figure 7:
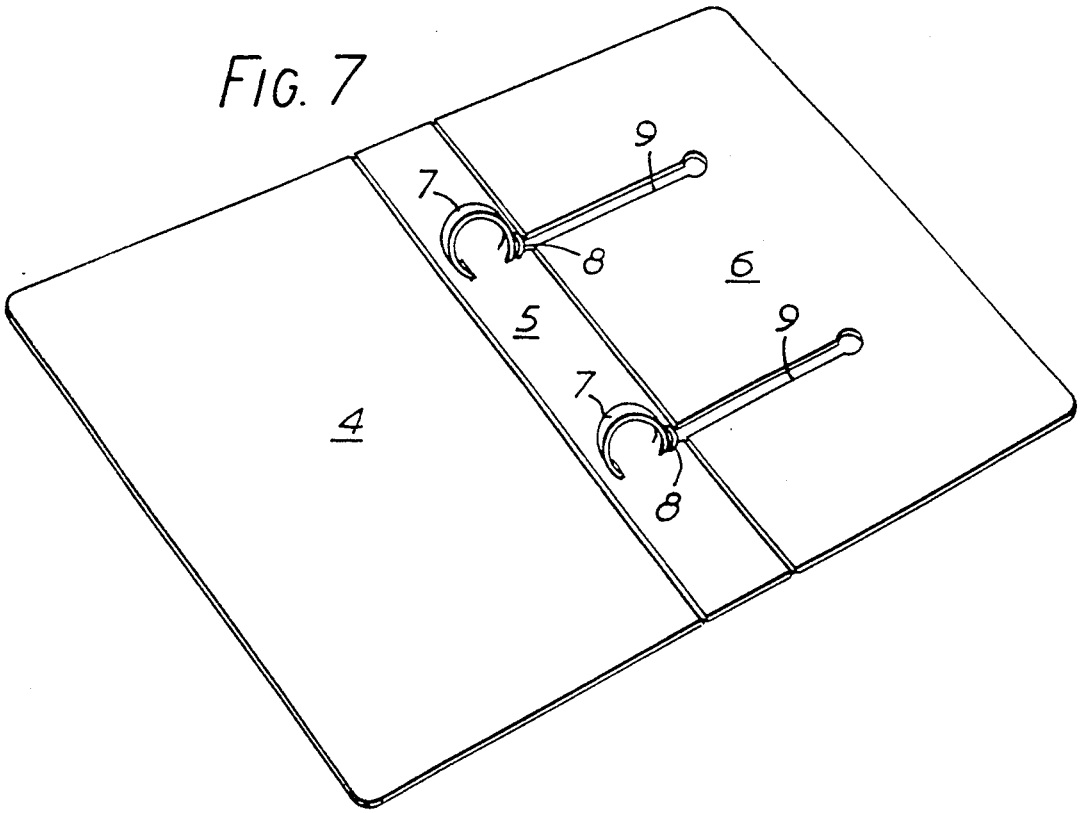
FIG. 7 is a perspective view of the binder of FIG. 1 after the final stage of a binding operation.
Figure 8:
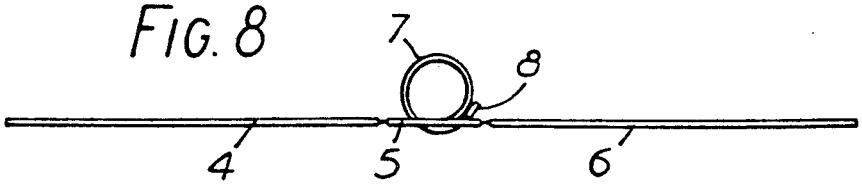
FIG. 8 is an end view of binder in its state shown in FIG. 7.

As shown in FIGS. 7 and 8, during the final stage of a binding operation, the heads 8 are pushed though the apertures 9 and thus secured in position by engaging the inner surface of spine 5. As may be seen in FIG. 9, the binder has a generally neat appearance and the heads 8 are neither present, nor can be seen, on the outside of the binder 1.

Although in the example described above there are a pair of strips 7 for binding sheet articles in position, there may be more than two such strips, for example three strips. By way of modification, the shape of heads 8 may be modified so that the heads can be retained on the outer surface of spine 5 after being passed through apertures 11. The shapes of heads 8 and apertures 11 are desirably configured so that the heads can pass through the apertures without causing any deformation to the heads or the apertures.

Returning now to FIG. 1, in order to bind an article, such as a pen, to the rear panel 6, the article is first placed on strip 12. The head 13 is then passed from the inner surface of rear panel 6 around notch 16 to the outer surface. Finally, the head is passed from the aperture from which strip 12 is cut so that it can engage the surface of rear panel 6 and thereby be secured in position.

In the example given above, the binder is formed from a sheet of polypropylene material. The thickness of this material is selected so that the panels 4, 6 and the spine 5 are semi-rigid and so there is sufficient flexibility to bind the strips 7, 12 into a ring shape but insufficient flexibility to allow deformation of the heads after completion of a binding operation. Other materials, such as PVC or steel, can be used in place of polypropylene, the thickness being selected so as to provide the properties just mentioned.

I claim:

1. A binder comprising:

a sheet of material arranged to be bent so as to form a front panel and a rear panel;

at least two binder strips for binding sheet articles to the binder, each binder strip extending from said sheet at a respective first position, each binder strip including an individual head provided at the free end of each binder strip, each binder strip and its associated head being formed from said material;

an individual aperture associated with each strip and formed in said sheet at a respective second position, each binder strip, associated head and associated aperture being arranged so that the head can pass through the aperture; and means for securing each head in position after it has been passed through its associated aperture, in which, for each binder strip the respective first and second positions lie in a common plane when the front and rear panels are closed together.

2. A binder strip as claimed in claim 1, wherein said sheet of material is arranged to be bent so as to form a central spine between the front and rear panels and, for each binder strip, said respective first and second positions are located on the spine.

3. A binder strip as claimed in claim 1, wherein for each binder strip, the head and said individual aperture are configured so that the head can pass through said individual aperture without deformation.

4. A binder strip as claimed in claim 1, wherein for each binder strip, the securing means comprises the aperture from which the head is cut.

5. A binder comprising:

a sheet of material arranged to be bent so as to form a front panel and a rear panel;

at least one binder strip for binding a device to a surface of the binder, said at least one binder strip extending from said sheet at a position adjacent an edge of the sheet; and an individual head provided at a free end of said at least one binder strip, said at least one binder strip and associated head being cut from said material, said at least one binder strip and associated head being arranged so that the head can be passed around said edge of the sheet and then through the aperture formed by cutting the strip and head from the material to be secured against the surface of the material to form a binder ring.

6. A binder comprising:

a sheet of material arranged to be bent so as to form a front panel, a rear panel and a spine between the front and rear panels;

at least two binder strips extending from said sheet;

an individual head provided at the free end of each strip;

each binder strip and associated head being cut from said material and thereby forming a first individual aperture in the rear panel associated with the strip; and an individual second aperture associated with each strip and formed in said spine, each strip, associated head and associated first and second apertures being arranged so that the head can pass through the second aperture without deformation and then through the first aperture to be secured in position against the surface of the material to form a binder ring.

7. A binder strip as claimed in claim 6, wherein each individual strip has a partly circular shape.

8. A binder strip as claimed in claim 6, wherein each individual second aperture is a single second aperture.

9. A binder strip as claimed in claim 6, wherein each binder strip extends from said sheet at a position in the spine.

* * * * *